US007324410B1

(12) United States Patent
Ziv

(10) Patent No.: US 7,324,410 B1
(45) Date of Patent: Jan. 29, 2008

(54) WATCH WITH SPECIAL BACK

(76) Inventor: Amir Ziv, 2461 NW. 73RD Ave., Sunrise, FL (US) 33313

( * ) Notice: Subject to any disclaimer, the term of this patent is extended or adjusted under 35 U.S.C. 154(b) by 108 days.

(21) Appl. No.: 11/353,534

(22) Filed: Feb. 15, 2006

Related U.S. Application Data

(60) Provisional application No. 60/702,207, filed on Jul. 25, 2005, provisional application No. 60/762,031, filed on Jan. 25, 2006.

(51) Int. Cl.
*G04B 47/00* (2006.01)

(52) U.S. Cl. ..... 368/88; 368/283; 368/309

(58) Field of Classification Search ..... 368/88, 368/283, 309, 281, 278
See application file for complete search history.

(56) References Cited

U.S. PATENT DOCUMENTS

| | | | | |
|---|---|---|---|---|
| 3,242,664 | A * | 3/1966 | Lederrey | 368/281 |
| 4,180,970 | A * | 1/1980 | Tokunaga et al. | 368/243 |
| 4,332,020 | A * | 5/1982 | Leopold | 368/27 |
| 4,392,747 | A * | 7/1983 | Kumada et al. | 368/88 |
| 4,525,077 | A * | 6/1985 | Ketner | 368/77 |
| 4,684,264 | A * | 8/1987 | Paperno et al. | 368/283 |
| 5,142,512 | A | 8/1992 | Takano | |
| 5,155,713 | A | 10/1992 | Addor | |
| D386,981 | S | 12/1997 | Chae | |
| 5,768,217 | A * | 6/1998 | Sonoda et al. | 368/10 |
| 5,895,321 | A | 4/1999 | Gassies | |
| 5,923,622 | A | 7/1999 | Chung | |
| 5,943,302 | A | 8/1999 | Fanshaw | |
| 6,310,836 | B1 * | 10/2001 | Fujii et al. | 368/205 |
| 6,357,746 | B1 | 3/2002 | Sadowski | |
| 6,600,530 | B1 * | 7/2003 | Smith et al. | 349/98 |
| 6,724,691 | B1 * | 4/2004 | Kaminsky | 368/76 |
| 7,027,359 | B2 * | 4/2006 | Apotheloz et al. | 368/10 |
| 2004/0093897 | A1 * | 5/2004 | Weissbuch | 63/1.11 |

* cited by examiner

*Primary Examiner*—Gary Paumen
(74) *Attorney, Agent, or Firm*—Alvin S. Blum

(57) ABSTRACT

A pocket or wrist watch has a unique back member that is constructed to hold a disc by adhesive means. The disc may impart special importance to the watch. It may be constructed from a gaming chip. The watch movement may be housed in another portion of a gaming chip so that the face and back of the watch are seen as a gaming chip. In another form of the invention, the face of the watch and the disc back may be inscribed with various indicia having special meaning to a recipient.

17 Claims, 4 Drawing Sheets

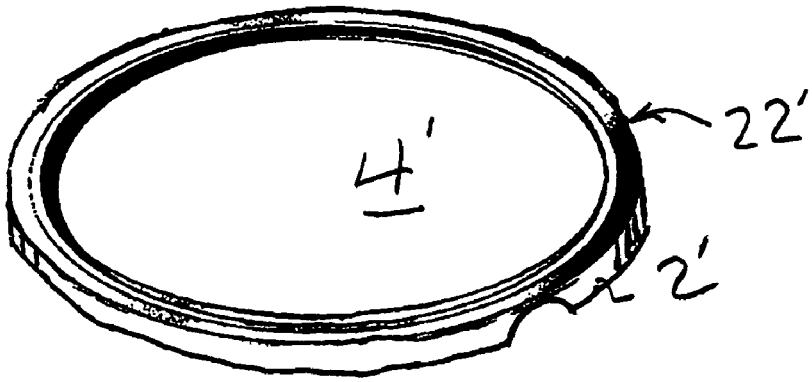
FIG. 3
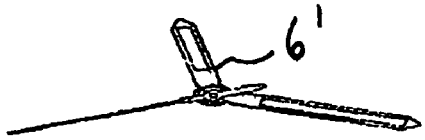
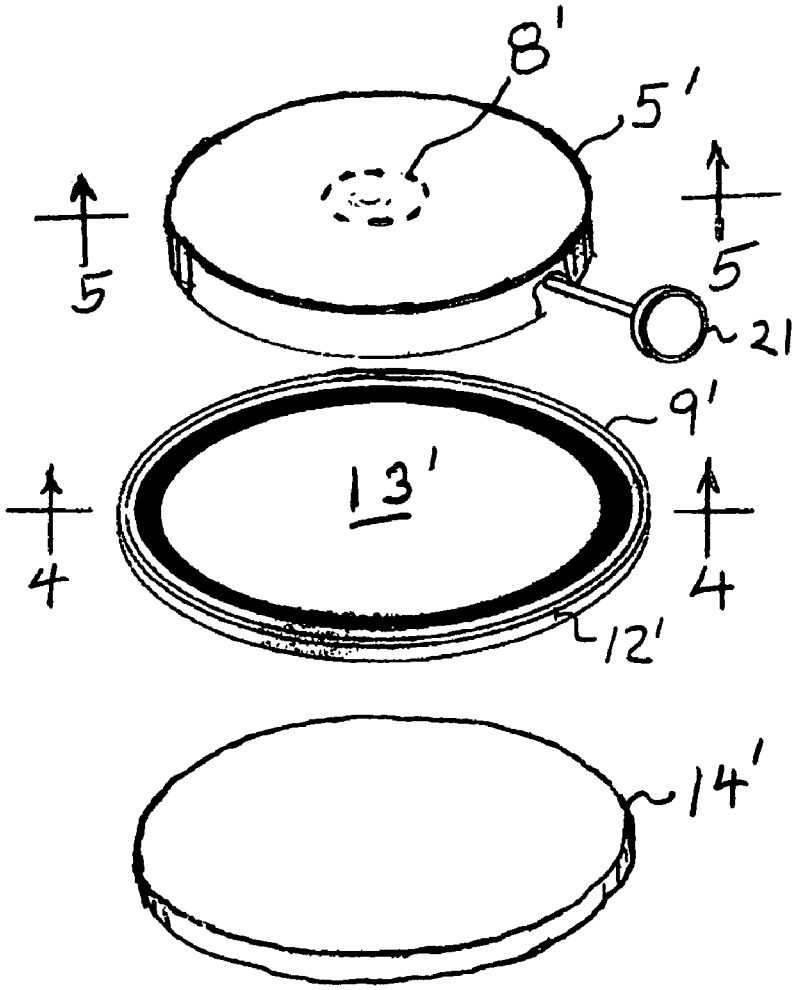

WATCH WITH SPECIAL BACK

Applicant claims priority of provisional patent application No. 60/702,207 filed Jul. 25, 2005 and provisional patent application No. 60/762,031 filed Jan. 25, 2006.

BACKGROUND OF THE INVENTION

This invention relates to watches, and more particularly to wrist and pocket watches having a special structure of the back element of the watch that enhances the market potential.

SUMMARY OF THE INVENTION

Wrist and pocket watches of the invention have a special construction of the back element of the watch that enables the incorporation of various elements into the watch structure that greatly enhances the market potential for the product.

In accordance with an aspect of the invention, a method is described for incorporating various desirable elements into a watch, including providing a special back structure.

In accordance with another aspect of the invention, a watch structure is described for incorporating a desirable element into a watch. This includes a special back construction to facilitate making the watch unique at the point of sales.

These and other objects, features, and advantages of the invention will become more apparent from the detailed description of an exemplary embodiment thereof as illustrated in the accompanying drawings, in which like elements are designated by like reference characters in the various drawing figures.

BRIEF DESCRIPTION OF THE DRAWINGS

FIG. 3 is an exploded view of a pocket watch of the invention.

DETAILED DESCRIPTION OF PREFERRED EMBODIMENTS

Before explaining the disclosed embodiments of the present invention in detail, it is to be understood that the invention is not limited in its application to the details of the particular arrangements shown, since the invention is capable of other embodiments. Also, the terminology used herein is for the purpose of description and not limitation.

Figure 1:
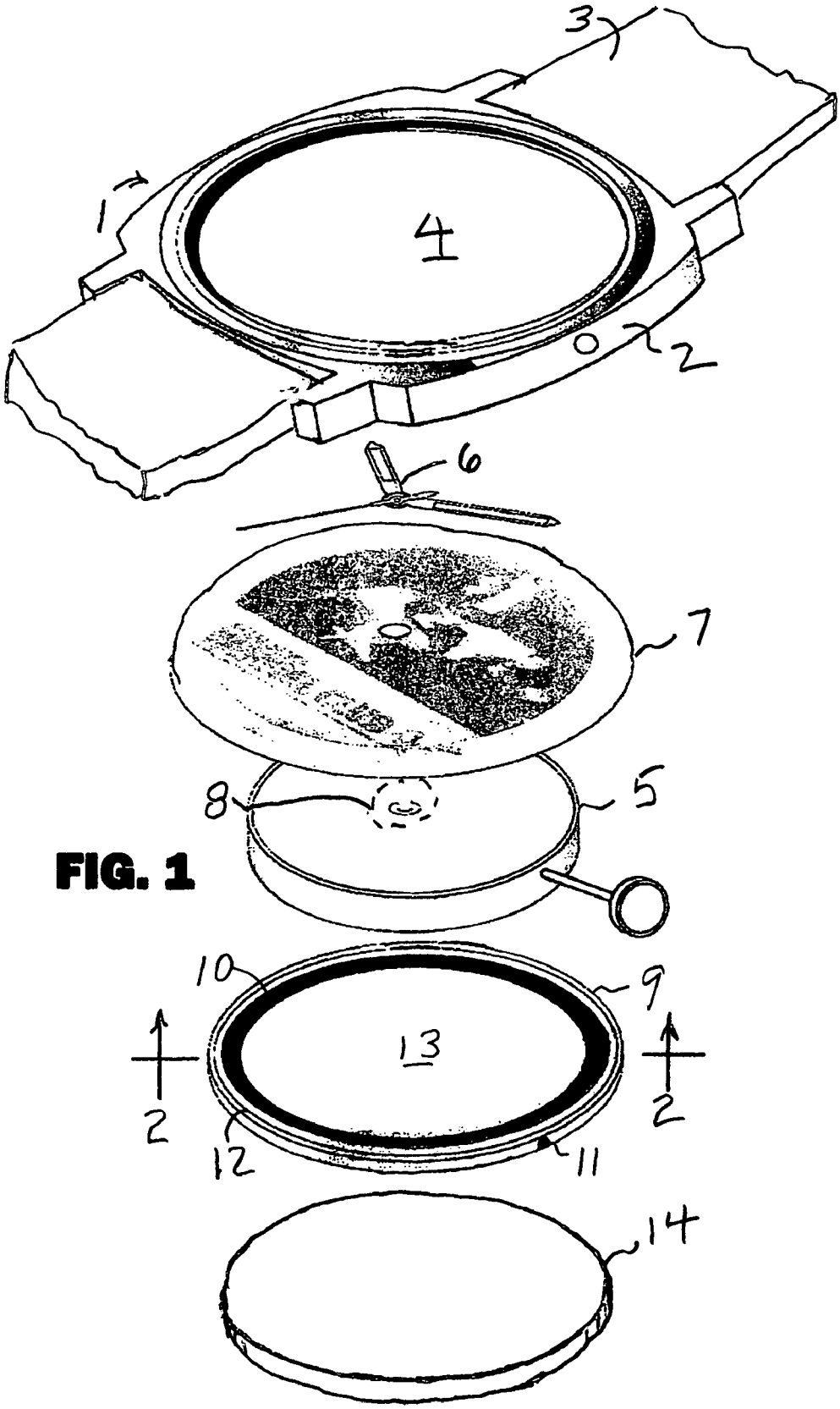
FIG. 1 is an exploded view of a wrist watch of the invention.
Figure 2:
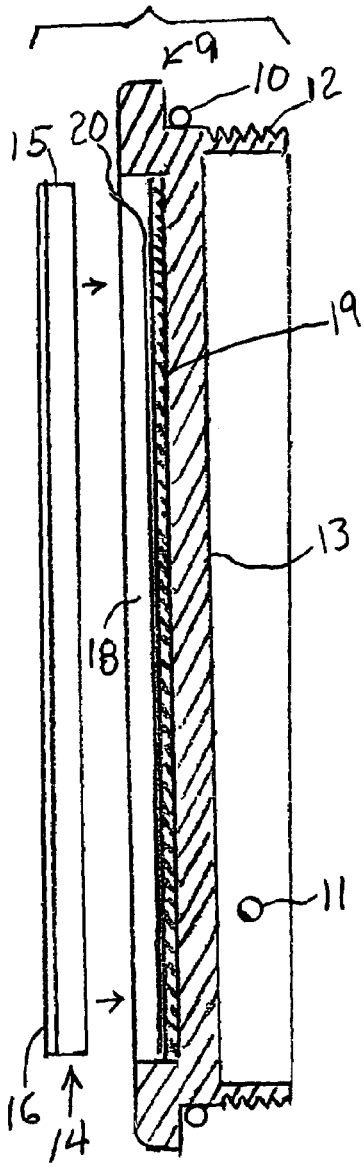
FIG. 2 is a sectional view taken through line 2-2 of FIG. 1.

Referring now first to the drawing FIGS. 1 and 2, the wrist watch 1 has a crystal 4 and wrist band 3 attached to a frame 2. A watch movement 8 (shown in phantom) within housing 5 operates the hands 6. A watch face 7 between the hands and the movement may be the front half of a gaming chip, or be decorated to provide special meaning such as a commemoration of a retirement or special occasion. These all fit within the frame. The back 9 has a closing plate 13 and O-ring 10. The back 9 has male threads 12 to cooperate with female threads (not shown) on the frame to close and seal the entire watch. Spanner wrench holes 11 well known in the art may be provided to facilitate rotation of the back. The back 9 has a recess 18 coated with a pressure sensitive adhesive 19 protected with release sheet 20. The release sheet 20 may be peeled off and a disc 14 may be affixed to the back. The disc may take many forms. A preferred disc 14 features a clear hard layer 16 and an inscribable layer 15. By inscribing on layer 15, the marked upon portion is removed, so that the color of the closing plate 13 shows through. This may even be done at the retail level to personalize a gift watch. Alternatively, the back side of a gaming chip (not shown) may be adhered to the back 9 to give the appearance of a complete gaming chip/watch.

Figure 4:
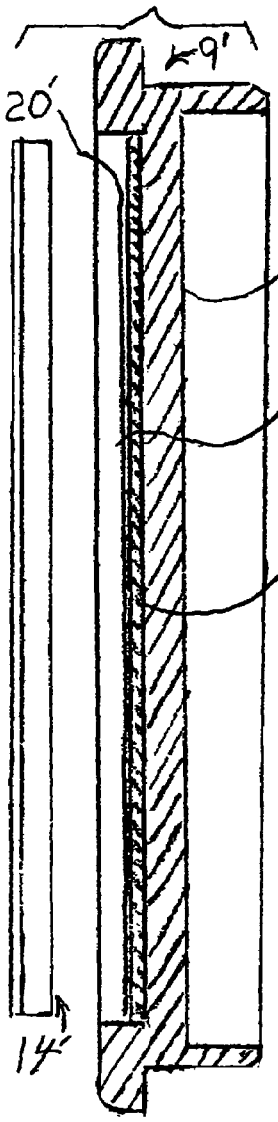
FIG. 4 is a sectional view taken through line 4-4 of FIG. 3.
Figure 5:
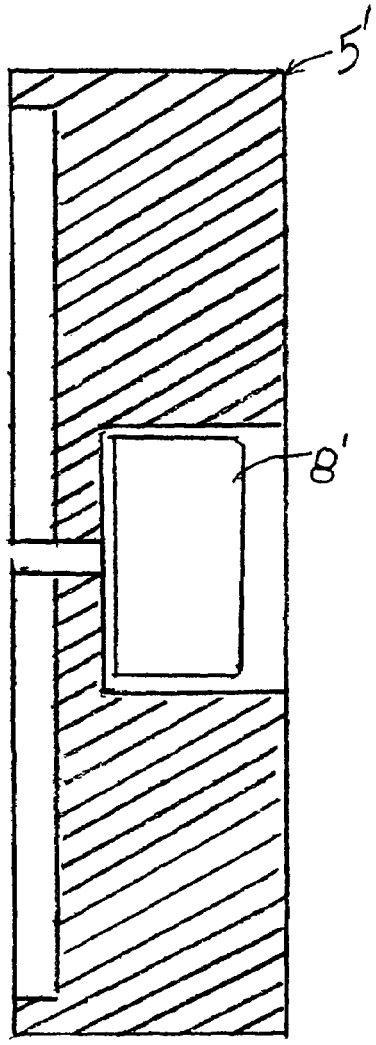
FIG. 5 is a sectional view taken through line 5-5 of FIG. 3.

Referring now to drawing FIGS. 3-5, a pocket watch 22 of the invention has a frame 2' holding a crystal 4'. A watch movement 8' within housing 5' operates the hands 6'. The housing 5' may be cut from the front half of a gaming chip, or be decorated to provide special meaning such as a commemoration of a retirement or special occasion. These all fit within the frame. The back 9' has a closing plate 13'. The back 9' snaps into the frame in a manner well known in the art to close and seal the entire watch. The back 9' has a recess 18' coated with a pressure sensitive adhesive 19' protected with release sheet 20'. The release sheet 20' may be peeled off and a disc 14' may be affixed to the back. The disc may take many forms. A preferred disc 14' is the back side of a gaming chip that may be adhered to the back 9' to give the appearance of a complete gaming chip/watch when the housing 5' is the front section of the gaming chip.

Figure 6:
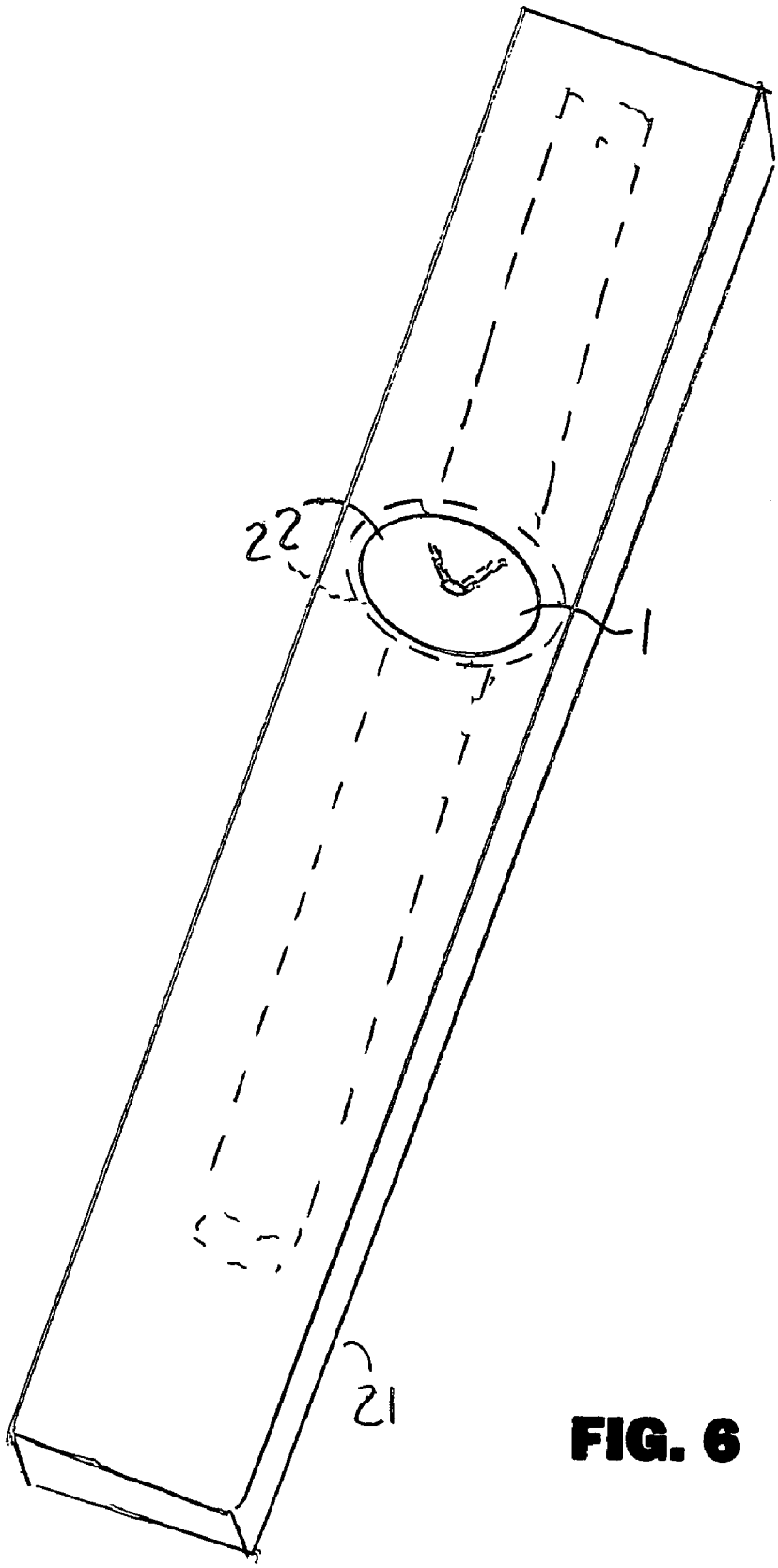
FIG. 6 is a perspective view of a package insert for containing a watch of the invention.

Referring now to FIG. 6, an elongate rectangular protective sleeve 21 encloses the watch for transport. It is provided with a pair of opposed apertures 22 to provide a view of the front and rear faces of the watch.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. In a watch having a front and a back, a frame with annular front and back sides, a movement and hands connected to the movement in a housing within the frame, and a crystal sealingly protecting the hands at the front side of the frame, a watch back member comprising:

a closing plate constructed to close the back side of the frame;

a first annular ring extending from a first face of the closing plate provided with sealing means for cooperating with an inner wall of the annular back side of the frame to thereby seal the watch from the environment;

a second annular ring extending from a second face of the closing plate, thereby providing a recess at the back of the watch; and adhesive means within the recess for adherently holding a disc within the recess.

2. The watch back member of claim 1 further comprising a release sheet covering the adhesive means.

3. The watch back member of claim 2 in which the disc is provided with indicia on a disc face away from the watch.

4. The watch back member of claim 2 in which the disc has a transparent first face and an opaque scratch off second face upon which indicia may be conveniently inscribed.

5. The watch back member of claim 1 in which the housing is formed from a portion of a gaming chip and the disc is formed from a portion of a gaming chip thereby providing a watch in the form of a gaming chip.

6. The watch back member of claim 4 further comprising a wrist band attached to the frame.

7. A watch having a front and a back, the watch comprising:

a frame with annular front and back sides;

a movement and hands connected to the movement in a housing within the frame;

a crystal sealingly protecting the hands at the front side of the frame;

a watch back member having a closing plate constructed to close the back side of the frame;

a first annular ring extending from a first face of the closing plate provided with sealing means for cooperating with an inner wall of the annular back side of the frame to thereby seal the watch from the environment;

a second annular ring extending from a second face of the closing plate, thereby providing a recess at the back of the watch; and adhesive means within the recess for adherently holding a disc within the recess.

8. The watch of claim 7 further comprising a release sheet covering the adhesive means.

9. The watch of claim 7 in which the disc is provided with indicia on a disc face.

10. The watch of claim 7 in which the housing is formed from a portion of a gaming chip and the disc is formed from a portion of a gaming chip thereby providing a watch in the form of a gaming chip.

11. The watch of claim 9 further comprising a wrist band attached to the frame.

12. The watch of claim 10 further comprising a wrist band attached to the frame.

13. The watch of claim 12 further comprising an elongate rectangular protective sleeve constructed to enclose the watch and wrist band, the sleeve provided with a pair of opposed apertures positioned to provide visual access to the front and back of the watch.

14. The watch of claim 7 in which the disc has a transparent first face and an opaque scratch off second face upon which indicia may be conveniently inscribed.

15. The watch of claim 8 in which the disc has a transparent first face and an opaque scratch off second face upon which indicia may be conveniently inscribed.

16. The watch of claim 15 further comprising an elongate rectangular protective sleeve constructed to enclose the watch and wrist band, the sleeve provided with a pair of opposed apertures positioned to provide visual access to the front and back of the watch.

17. The watch of claim 8 in which the sealing means for cooperating with the inner wall of the annular back side of the frame includes an O-ring and screw threads.

* * * * *